US010653206B2

(12) United States Patent
Chaney

(10) Patent No.: US 10,653,206 B2
(45) Date of Patent: May 19, 2020

(54) ALL TERRAIN SOLES

(71) Applicant: Brian Chaney, Portland, OR (US)

(72) Inventor: Brian Chaney, Portland, OR (US)

( * ) Notice: Subject to any disclaimer, the term of this patent is extended or adjusted under 35 U.S.C. 154(b) by 215 days.

(21) Appl. No.: 16/017,761

(22) Filed: Jun. 25, 2018

(65) Prior Publication Data

US 2019/0008232 A1 Jan. 10, 2019

Related U.S. Application Data

(60) Provisional application No. 62/530,519, filed on Jul. 10, 2017.

(51) Int. Cl.

| | |
|---|---|
| ***A43B 13/26*** | (2006.01) |
| ***A43B 13/04*** | (2006.01) |
| ***A43B 13/12*** | (2006.01) |
| ***A43C 15/16*** | (2006.01) |
| ***A43B 5/00*** | (2006.01) |
| ***A43C 15/06*** | (2006.01) |
| ***A43C 15/02*** | (2006.01) |
| ***A43C 15/00*** | (2006.01) |
| ***A43B 13/36*** | (2006.01) |

(52) U.S. Cl.

CPC ..... *A43B 13/26* (2013.01); *A43B 5/00* (2013.01); *A43B 13/04* (2013.01); *A43B 13/122* (2013.01); *A43C 15/061* (2013.01); *A43C 15/161* (2013.01); *A43C 15/168* (2013.01); *A43B 13/36* (2013.01); *A43C 15/005* (2013.01); *A43C 15/02* (2013.01); *A43C 15/167* (2013.01)

(58) Field of Classification Search

CPC ..... A43B 13/26; A43B 5/00; A43B 13/04; A43B 13/122; A43B 13/36; A43B 3/24; A43B 3/244; A43B 3/246; A43B 13/28; A43B 5/02; A43C 15/061; A43C 15/161; A43C 15/168; A43C 15/005; A43C 15/02; A43C 15/167

USPC ..... 36/25 R, 15, 100, 101, 62, 64, 65, 66, 36/32 R, 12, 124, 134, 126, 127, 128

See application file for complete search history.

(56) References Cited

U.S. PATENT DOCUMENTS

| | | | | | |
|---|---|---|---|---|---|
| 3,755,929 | A * | 9/1973 | Frisch | A43B 5/18 | 36/7.6 |
| 3,866,339 | A * | 2/1975 | Latto | A43B 5/18 | 36/100 |
| 4,107,858 | A * | 8/1978 | Bowerman | A43B 5/00 | 36/134 |
| 4,782,604 | A * | 11/1988 | Wen-Shown | A43B 5/001 | 36/127 |
| 4,984,377 | A * | 1/1991 | Schneider | A43B 13/26 | 36/134 |
| 5,317,822 | A * | 6/1994 | Johnson | A43B 13/36 | 36/101 |
| 5,644,857 | A * | 7/1997 | Ouellette | A43B 3/24 | 36/127 |

(Continued)

*Primary Examiner* — Justin M Jonaitis
(74) *Attorney, Agent, or Firm* — Mark S Hubert

(57) ABSTRACT

A sole designed for attachment to an article of footwear, made of a hard polymer outsole connection plate affixed to a flexible polymer outsole that has a series of threaded imbed anchors housed therein for the attachment of various designs of interchangeable cleats. The cleats reside in detents formed on planar channels across the width of the outsole and extend above a series of tapered raised pads formed on the bottom face of the outsole.

19 Claims, 10 Drawing Sheets

(56) References Cited

U.S. PATENT DOCUMENTS

| | | | | | |
|---|---|---|---|---|---|
| 5,657,558 | A * | 8/1997 | Pohu | A43B 5/14 | 36/100 |
| 5,979,083 | A * | 11/1999 | Robinson | A43B 1/0072 | 36/102 |
| 7,836,610 | B2 * | 11/2010 | Laporte | A43C 15/08 | 36/62 |
| 7,866,064 | B2 * | 1/2011 | Gerber | A43C 15/161 | 36/100 |
| 2004/0088883 | A1 * | 5/2004 | Workman | A43B 3/18 | 36/15 |
| 2007/0227039 | A1 * | 10/2007 | Chaney | A43B 5/08 | 36/15 |
| 2008/0222920 | A1 * | 9/2008 | Rovida | A43B 5/18 | 36/100 |

* cited by examiner

FIG. 6
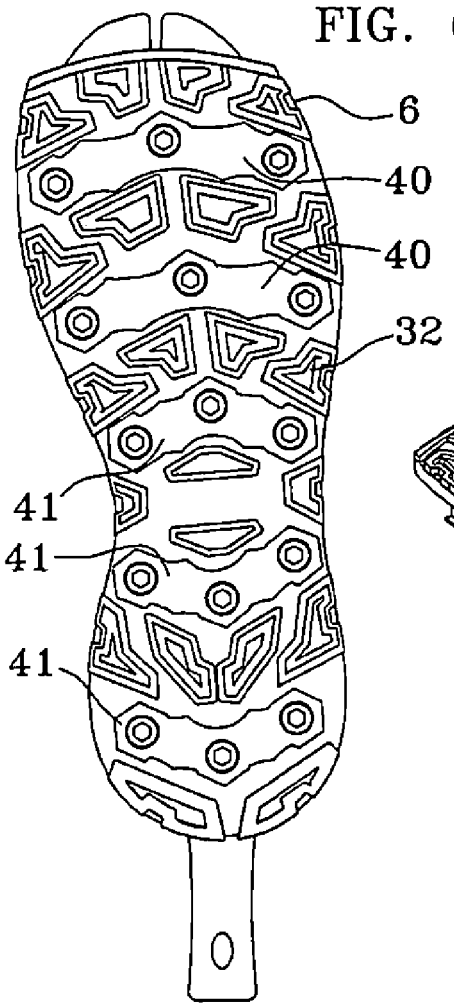
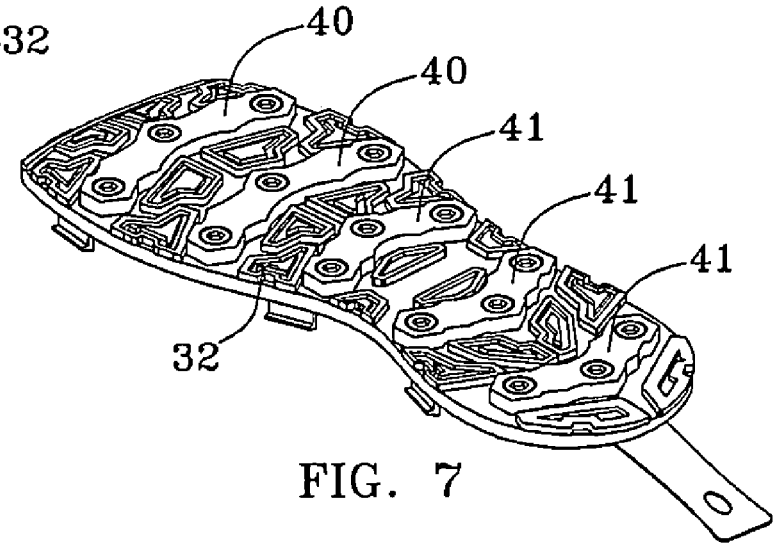
FIG. 7
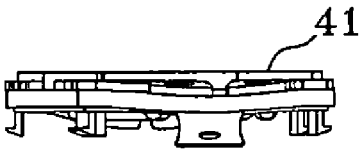
FIG. 8
FIG. 9
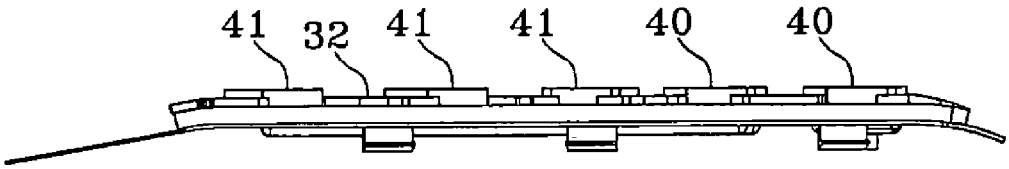

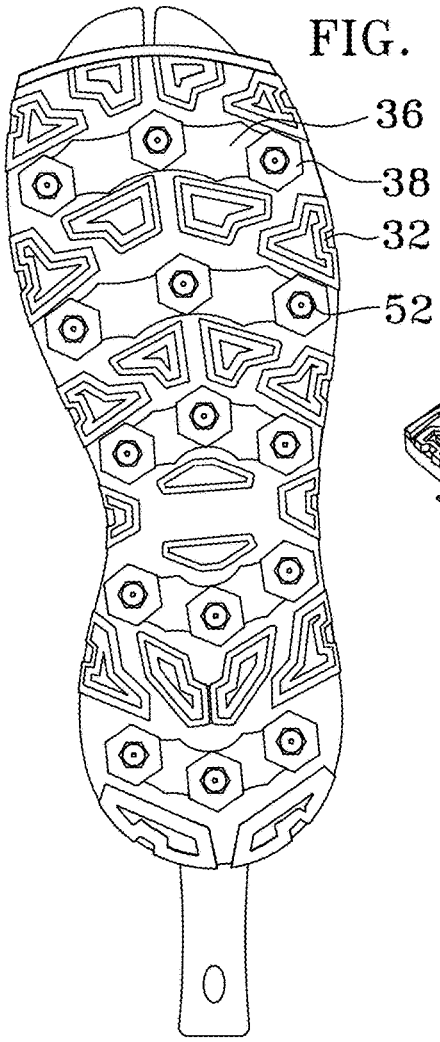
FIG. 10
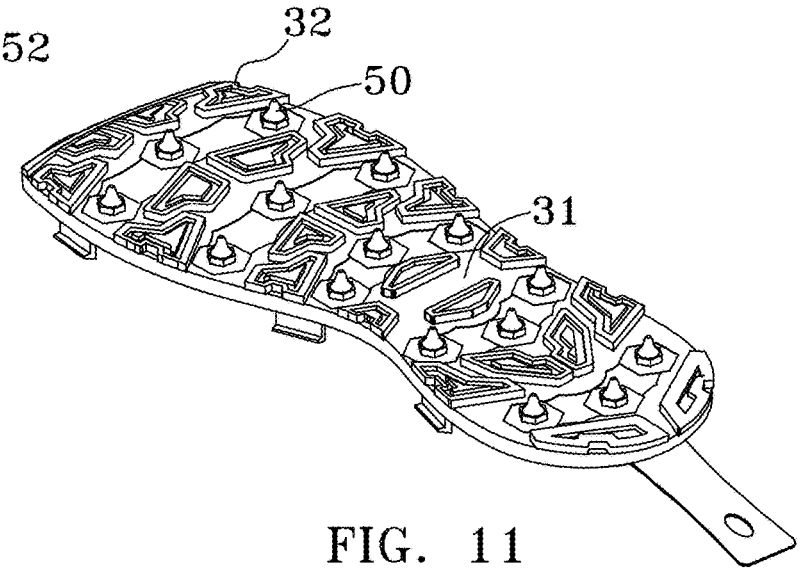
FIG. 11
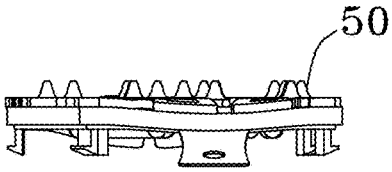
FIG. 12
FIG. 13
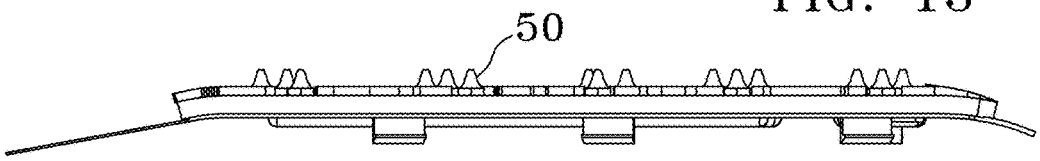

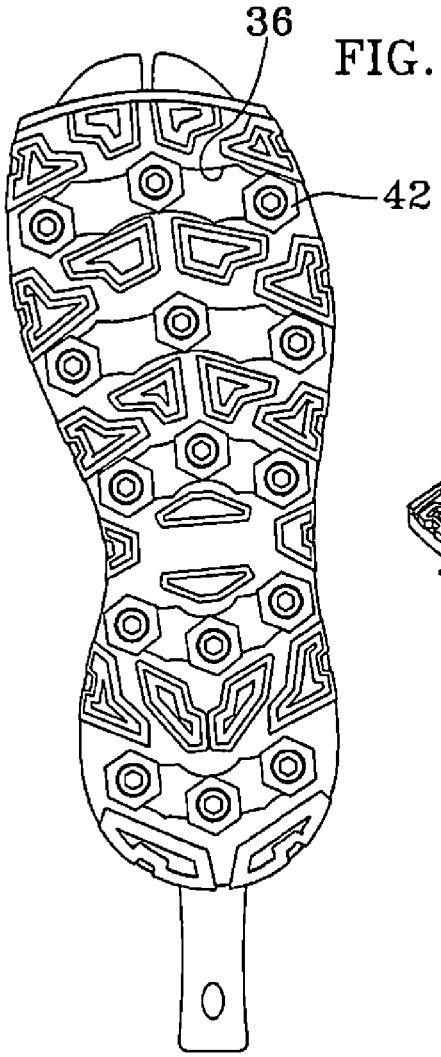
FIG. 14
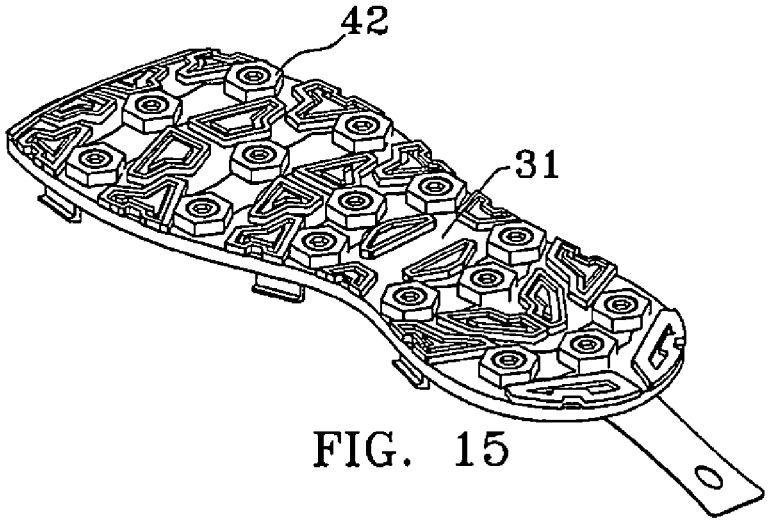
FIG. 15
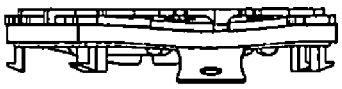
FIG. 16
FIG. 17
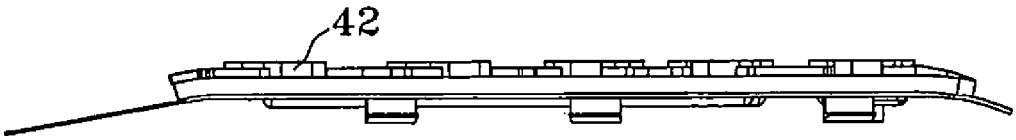

FIG. 26
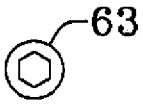
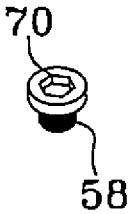
FIG. 27
FIG. 28
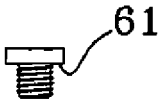
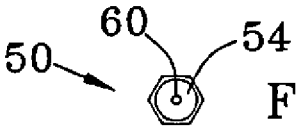
FIG. 29
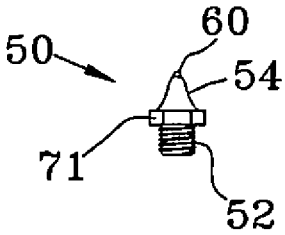
FIG. 30
FIG. 31
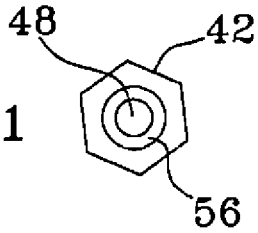
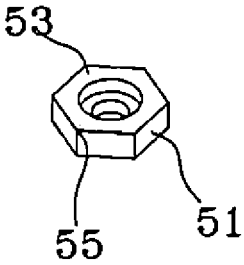
FIG. 32
FIG. 33
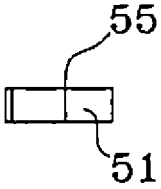
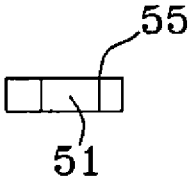
FIG. 34

ALL TERRAIN SOLES

PRIORITY

This application claims priority to and incorporates by reference in its entirety, U.S. Provisional Utility Application Ser. No. 62/530,519 entitled all terrain soles and filed Jul. 10, 2017.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to attachable shoe soles, and more particularly to soles designed for all types of treacherous terrains or conditions such as slippery water terrain, smooth rocks, mossy wet rocks, moss covered roofs, wood, snow and ice, etc.

BACKGROUND

Fishermen that fish from the banks of waterways encounter treacherous footpaths. There is moss and algae covering the shoreline as well as large, current smoothed rocks to lose one's footing on. Prior art conventional boots and shoes utilize polymer soles with aggressive style treads geared more for terra firma. These, while providing good traction on the shore, do not fare well when in the water. Similarly, roofers encounter slippery roofs with similar problems and poor solutions.

Outdoor shoes or boots are generally geared to a specific type of terrain, whether it be gravel, bush, sand, rock, etc. The purpose dictates the design and components of the footwear. The soles may be made of a polymer with a low durometer or a high durometer, the spacing on the sole pads may be narrow or wide, and there may be sole traction imbeds for enhanced grip. The problem with these types of prior art footwear is encountered when an outdoorsman is traversing mixed terrain. A certain sole design may be of huge benefit and offer superior traction advantage over loose gravel yet pose a treacherous situation when used on slippery, wet stones or on mossy boulders.

Thus, adaptable and specifically tailorable footwear that can be configured for the various terrains expected to be encountered, either prior to entering that area or at the site would be a welcome option to the outdoorsman terrain that is slippery, whether above or below a waterline, woulis provided by the embodiments set forth below.

BRIEF SUMMARY

In accordance with various embodiments, a removable outsole for placement over a shoe or boot, that can be configured with any combination of various traction cleats is provided.

In one aspect, an outsole that can be removably attached to the bottom of footwear and that has a series of threaded implants therein to accept mechanical fasteners to attach any of a plethora of traction devices thereon is provided.

In another aspect, a removable outersole for attachment to the bottom of footwear that has a patterned grid of threaded imbeds each which is adapted for the mechanical attachment of removable, individual cleats, studs or a common cleat bar is provided.

In yet another aspect, a two-part conjoined outersole system designed with an alternating series of raised pads, multi patterned cleat nesting detents and interchangeable traction cleats designed to allow mud ejection between the raised pads yet prevent small stones from wedging between the traction cleats and the raised pads so as to prevent the prying lose or out of the traction cleats, is provided.

In a final aspect, an outersole system designed with an alternating series of raised pads, multi patterned cleat nesting detents and interchangeable traction cleats, for incorporation onto a shoe, boot or wader.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

FIG. 6 is a bottom view of the outsole with the chevron cleats;

FIG. 7 is a perspective bottom view of the outsole with the chevron cleats;

FIG. 8 is an end view of the outsole with the chevron cleats;

FIG. 9 is a side view of the outsole with the chevron cleats;

FIG. 10 is a bottom view of the outsole with the studs;

FIG. 11 is a perspective bottom view of the outsole with the studs;

FIG. 12 is an end view of the outsole with the studs;

FIG. 13 is a side view of the outsole with the studs;

FIG. 14 is a bottom view of the outsole with the hexagonal cleats;

FIG. 15 is a perspective bottom view of the outsole with the hexagonal cleats;

FIG. 16 is an end view of the outsole with the hexagonal cleats;

FIG. 17 is a side view of the outsole with the hexagonal cleats;

FIG. 26 is a top view of the cleat mechanical fastener

FIG. 27 is a top perspective view of the cleat mechanical fastener;

FIG. 28 is a side view of the cleat mechanical fastener;

FIG. 29 is a top view of the stud;

FIG. 30 is a side view of the stud;

FIG. 31 is a bottom view of a hexagonal cleat;

FIG. 32 is a bottom view of a hexagonal cleat;

FIG. 33 is a front side view of a hexagonal cleat;

FIG. 34 is rear side view of a hexagonal cleat;

FIG. 36 is a cross sectional view of the imbeds and the outsole with the raised pads removed.

Figure 1:
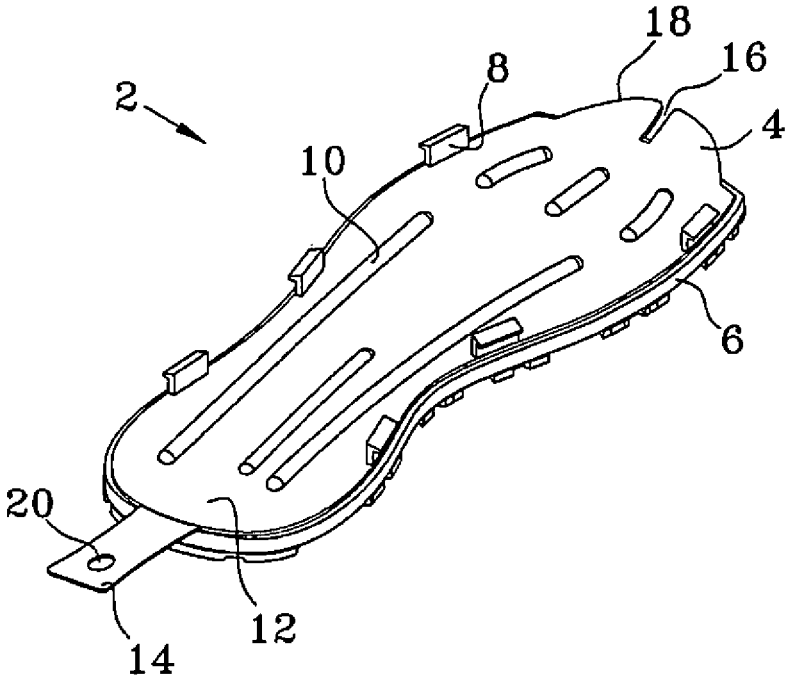
FIG. 1 is a perspective top view of an attachable sole.
Figure 2:
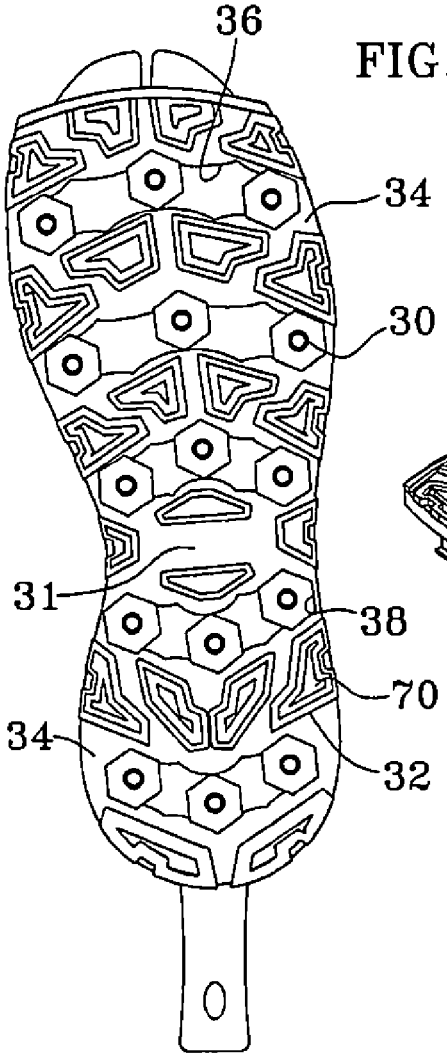
FIG. 2 is a bottom view of the outsole showing the raised pads and the cleat nesting detents.
Figure 3:
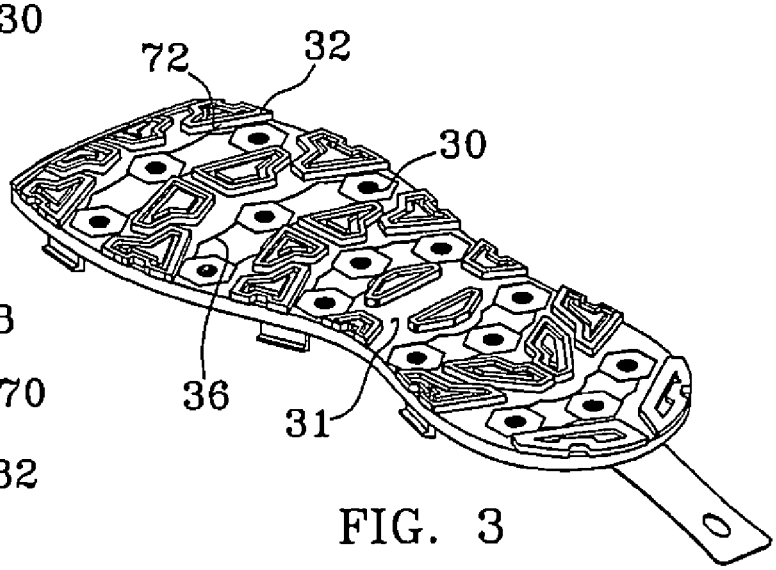
FIG. 3 is a perspective bottom view of the outsole showing the raised pads and the cleat nesting detents.
Figure 4:
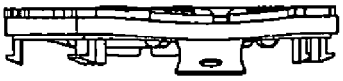
FIG. 4 is an end view of the outsole showing the raised pads and the cleat nesting detents.
Figure 5:
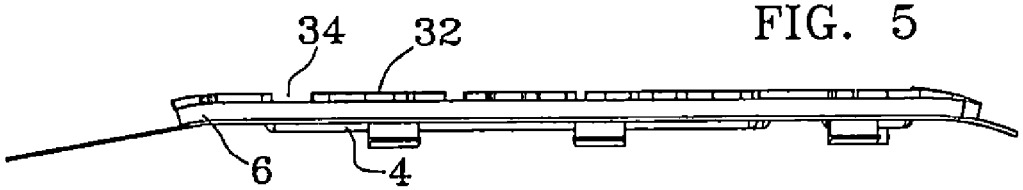
FIG. 5 is a side view of the outsole showing the raised pads and the cleat nesting detents.
Figure 18:
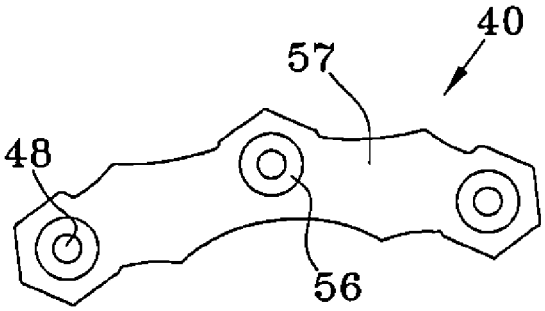
FIG. 18 is a bottom view of the large chevron cleat.
Figure 19:
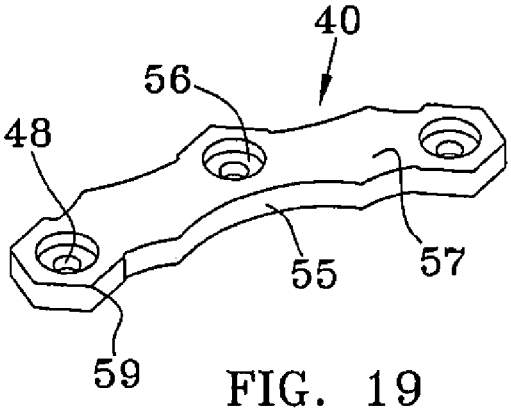
FIG. 19 is a bottom perspective view of the large chevron cleat.
Figure 20:
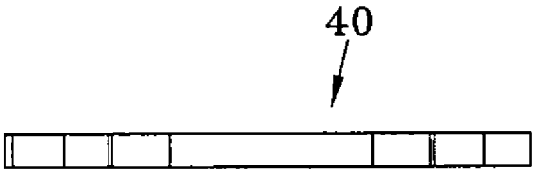
FIG. 20 is a side view of the large chevron cleat.
Figure 21:
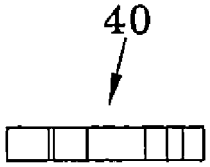
FIG. 21 is an end view of the large chevron cleat.
Figure 22:
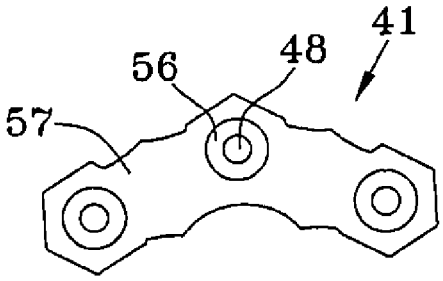
FIG. 22 is a bottom view of the small chevron cleat.
Figure 23:
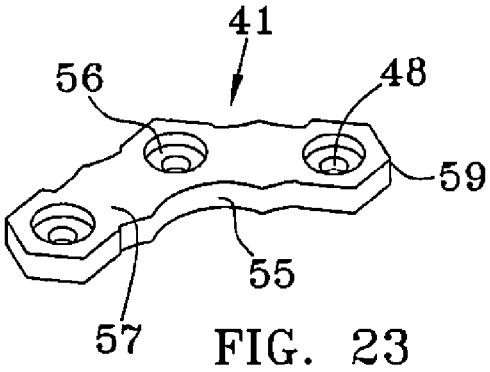
FIG. 23 is a bottom perspective view of the small chevron cleat.
Figure 24:
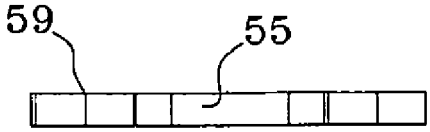
FIG. 24 is a side view of the small chevron cleat.
Figure 25:
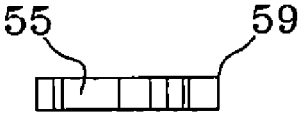
FIG. 25 is an end view of the small chevron cleat.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As used herein, the term "traction cleat" or "cleat" refers to any of a group of elements that protrude beyond the plane of the outer sole established at the top of the sole's raised pads. The traction cleats may take any of a plethora of shapes including hexagons, chevrons, and studs, to name a few.

As used herein, the term "sole" and "all terrain sole" are interchangeable and refer to a unit made of a resilient outsole connection plate affixed to the top face of an outsole that is mechanically coupled to any type of a traction cleat, preferably by an externally threaded fastener and a matingly conformed internally threaded outsole imbed anchor nut.

As used herein, the term "outsole connection plate" refers to a rigid or resilient polymer plate that is affixed to an outsole and that is attachable to the bottom surface of an article of footwear such as a boot, via features thereon the article of footwear that matingly engage complimentary features on the outsole connection plate.

The present invention relates to a novel design for all terrain soles with traction cleats that may be individually configured for the best possible traction based on the terrain and the conditions to be traversed. Although discussed primarily as an outsole coupled to an upper outsole connection plate, the combination of which is removeably affixed to a bottom face of separate article of footwear, the outsole may be incorporated into the fabrication of a boot or shoe without the outsole connection plate so as to be its outsole.

Looking at FIG. 1, it can be seen that the all terrain soles 2 have an upper polymer outsole connection plate 4 affixed to a lower polymer outsole 6. Preferably the method of affixation is by gluing with a high bond strength, waterproof epoxy, or the equivalent at their interface, however other means of affixation such as mechanical coupling could also be used. The outsole connection plate 4 is of a high durometer polymer preferably in the range of 65 to 75 on the Shore D durometer scale while the outsole 6 is of a lower durometer polymer preferably in the range of a 50 to 90 on a Shore A durometer scale.

The sole 2 belongs to part of a shoe system that clips onto a separate article of footwear such as a shoe or boot that is adapted to releasably accept the six locking lugs 8 that extend upward from the top face 12 of the outsole connection plate 4, into matingly conformed recesses formed thereon. The front end of the outsole connection plate 4 has an overhang 18 extends beyond the front end of the outsole 6 and has a retention slot 16 formed therein to matingly engage a tab on the article of footwear so as to retain the front of the sole 2 to the article of footwear regardless of the flex and arc of the combined unit. At the rear of the outsole connection plate 4 is a retention strap 14 with an attachment orifice 20 formed there through. Preferably this is attached to the bottom side of the outsole connection plate 4 by a mechanical fastening means such as stitching. This retention strap 14 hooks onto a retention stud extending from the article of footwear. It serves the same purpose as the retention slot 16. (The article of footwear is not part of this disclosure as it is the subject of a separate patent.) The outsole connection plate 4 also has a series of raised arced ridges 10 formed along its top face 12.

Figure 35:
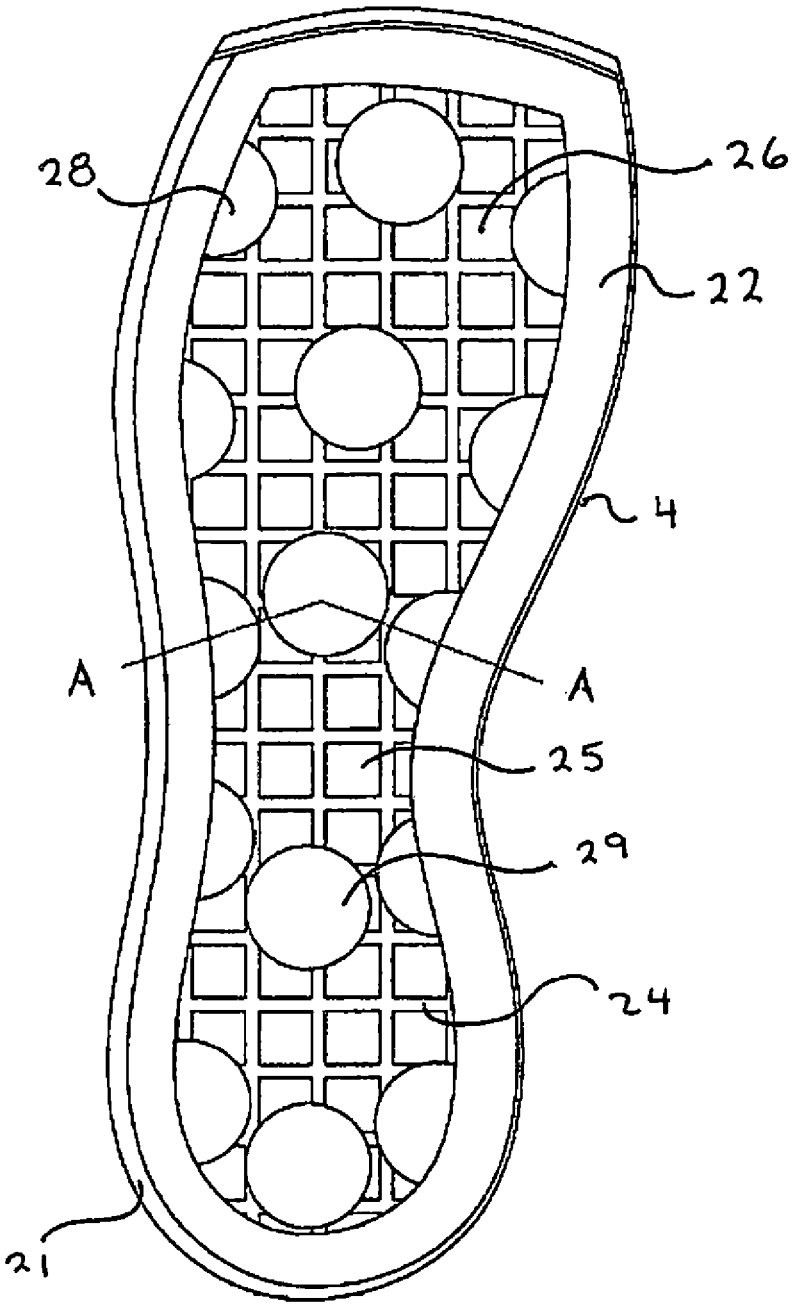
FIG. 35 is a bottom view of the outsole connection plate.
Figure 3G:
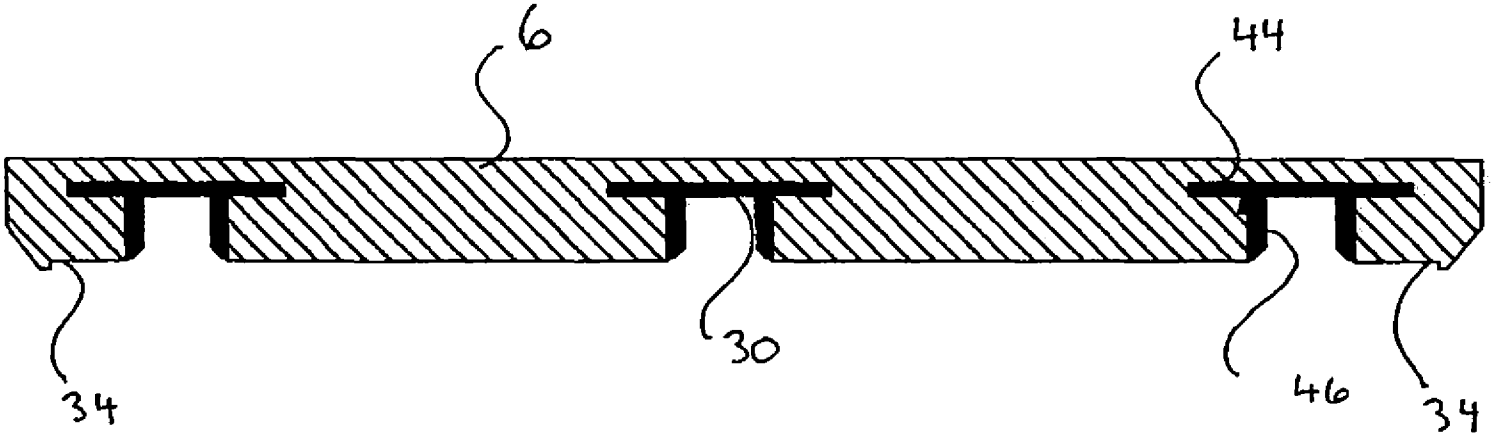

Looking at FIG. 35 it can be seen that the bottom planar face 22 of the outsole connection plate 4 has a solid thickened perimeter edge 21 enclosing a rectangular matrix of stiffening ribs 24 that reside between the bottom face 22 and the mid face 26 creating a series of rectangular voids 25. This maintains the strength and stiffness of the sole 2 while keeping material costs and weight at a minimum and providing a gluing surface with an increased surface area for the bonding of the outsole connection plate 4 to the outsole 6. Interspersed on the outsole connection plate 4 are thickened circular pads 29 that align with the imbeds 30 of the outsole 6. The circular pads 29, stiffening ribs 24 and perimeter edge 21 are all of the same thickness.

Looking at FIGS. 2-5, it can best be seen that the outsole 6 has a bottom face 31 that is flush with the top edges of a strategically patterned series of T shaped internally threaded imbed anchor nuts 30 (imbeds) that have been cast into the polymer of the outsole 6. Such imbeds 30 are well known in shoemaking, especially with respect to spiked athletic shoes. When the outsole polymer was poured around these imbeds 30, their circular bottom T (or flange sections) were completely encased in the outsole 4 and positioned so as to align with the thickened circular pads 29 on the outsole connection plate 4. This serves two purposes. First, it minimizes any deflection in the imbed 30 so that it will not work itself loose in the outsole 6 or abrade the surrounding polymer. Second, it will spread out the point loading on the outsole connection plate 4 when there are cleats affixed to the outsole 2. The bonding of the outsole 6 to the rigid outsole connection plate 4 also prevents excessive flexion of the outsole 6, increasing the lifespan of the imbeds.

The bottom face 31 of the outsole 6 has four predominant features. First, it has a series of tapered side raised pads 32 (with interior periphery channels on their exterior bottom surface) extending normally from the bottom face 31 and distributed in a patterned array. Second, there are five cleat channels 34 formed between the raised pads 32. These cleat channels 34 which are planar sections that extend axially completely across the width of the outsole 6, each have access to the imbeds 30 which reside approximately equidistant between the opposing raised pads 32 on opposite sides of the cleat channels. Third, there are three internally threaded imbed anchors 30 that are immovably entrained in the outsole 6, under each of the five cleat channels 34 such that their top edge resides coplanar or even with the cleat channels 34. Fourth, there are slight cleat locating detents formed in the cleat channels 34, on the bottom face 31 of the outsole 6. Each of these cleats locating detents is comprised of a regular, hexagonal first cleat detent 38 formed within a chevron second cleat detent 36. These two cleat detents 36 and 38 are complimentary in that their surface outlines overlap. The overall cleat locating detent bears the outline of one of the various sizes of the chevron cleats 40 (FIGS. 18-25) with the outline of the hexagonal cleat 42 (FIGS. 31-34) formed at either end, such that the two cleat locating detents have four common edges along the outer perimeter of the overall cleat locating detent. Stated differently, there are two hexagonal first cleat detents 38 that are nested in an overlapping fashion at either end of each of the chevron second cleat detents 36. These cleat locating detents serve to locate the proper size and position of these cleats upon installation, and to also prevent the hexagonal cleat 42 from rotating when its mechanical fastener is being installed such that none of its corners overlap the perimeter of the outsole 6. There is also a hexagonal first cleat detent centered in each of the chevron second cleat detents, approximately equidistant between the other two hexagonal first cleat detents at the ends of the chevron second cleat detent.

There are three types of cleats. The large chevron cleat 40 is shown in FIGS. 18-21 and the small chevron cleat 41 is shown in FIGS. 22-25. The hexagonal cleat 42 is shown in FIGS. 31-34. The stud cleat 50 is shown in FIGS. 29-30. All cleats are replaceable and also interchangeably connectable to the outsole 6. It will take either 3 stud cleats 50 or three hexagonal cleats 42 to replace any single chevron cleat, whether it is a large chevron cleat 40 or small chevron cleat 41. The outsole 6 need not be configured solely with any one type of cleat. The cleats may be mixed and matched onto the outsole 6 to accommodate the type of terrain that is expected to be encountered.

All three cleats have the same height of approximately ¼ inch when affixed to the outsole 6. Since the raised pads have a height of approximately ⅛ inch there is a ⅛-inch-high portion of cleat exposed on all sides above the raised pads. The raised pads 32 bear the same relationship of height exposure to the cleat channels 34.

The first two cleat styles, the hexagonal cleats 42 and the chevron cleats 40 and 41, are made in different materials where each different material is intended to maximize gripping ability depending on what surface and conditions they are intended to be used on. The cleats may be of soft aluminum so that their edges can slightly deform when under pressure against a solid surface such as a river rock, to increase grip, or they may be made from a steel or carbide to hold their edges sharp and to bite into softer material such as wood. High carbon (brittle) steel is not desirable as they can crack under point loads.

The chevron cleats are V shaped bodies having side walls 55 that are perpendicular to their top face 57 and have twelve sharp corner edges 59 formed at the interface of the side walls 55 and the top and bottom faces of this cleat. The ends of the chevron cleats are conformed to the same size and shape of the hexagonal cleats but having only four sides identical to those of the hexagonal cleats 42. (FIGS. 18-25).

Figure 37:
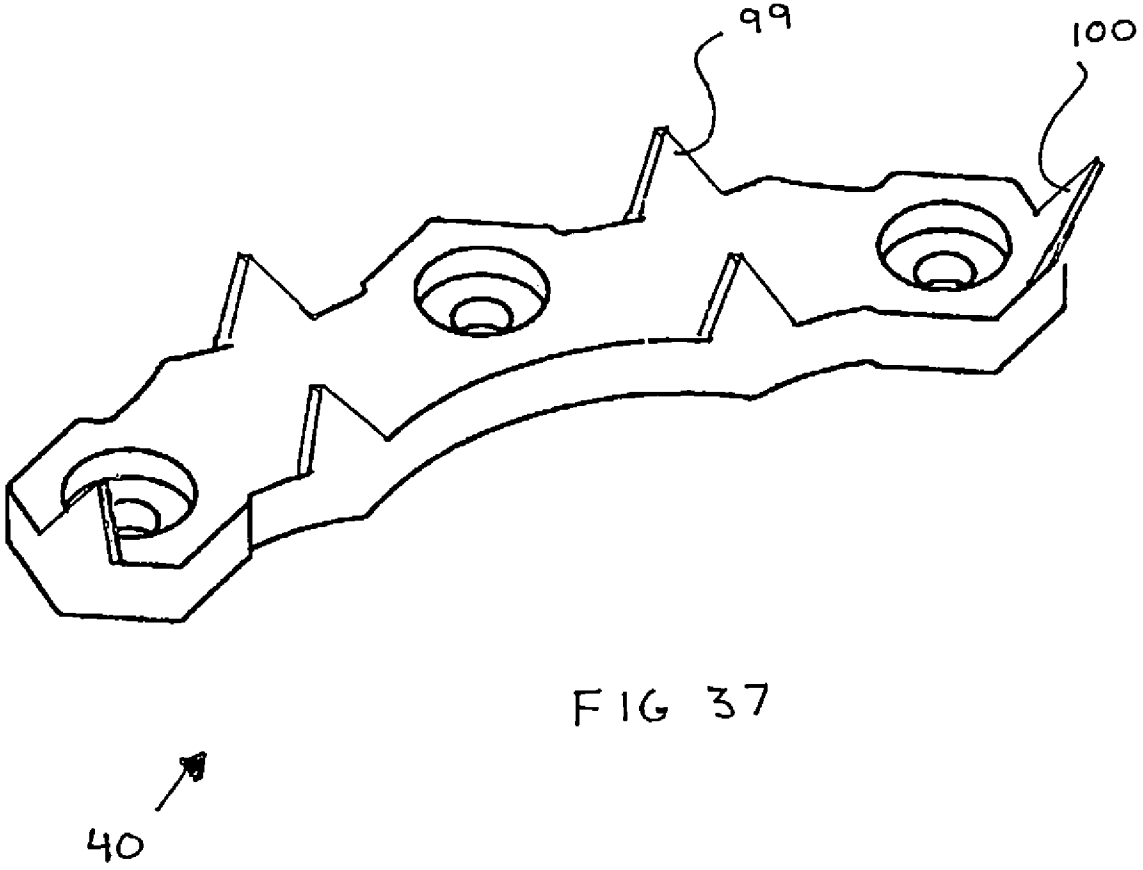
FIG. 37 is a side perspective view of a large chevron cleat with peripheral spikes.

In the alternate embodiment of the chevron cleat design illustrated in FIG. 37, it can be seen that the large chevron cleat 40 has a set of side spikes 99 and a pair of end spikes 100 extending from its peripheral edges. These spikes are integral with the chevron cleat and are formed by bending triangular sections of the cleat material formed about its edge at an acute angle with respect to the plane of the chevron cleat body. Although not illustrated, the alternate embodiment small chevron cleat is similarly conformed. In each of these chevron cleat designs there are at least two side spikes and at least one end spike, however four side spikes and two end spikes are the preferred configuration. These embodiments are for traversing ice and snow as well as softer surfaces such as wood.

The hexagonal cleats 42 have side walls 51 that are perpendicular to their top face 53 and resultantly, there are six sharp corner edges 55 formed at the interface of the side walls 51 and the top and bottom faces of this cleat. It is a regular hexagonal body such that each side wall is of the identical length and there is the same contained angle between adjacent side walls. (FIGS. 31-34)

It is to be noted that the side walls of the hexagonal cleats and the small and large chevron cleats reside approximately perpendicular (plus or minus 10 degrees) from the top face of the cleats. In the preferred configuration, there will be a 90 degree edges on these cleats. The hardness of the cleat material will determine how long the cleats will hold an edge under use. Since the cleats are removable they may be sharpened by applying a slight grinding to the sides.

The third cleat is a stud cleat 50. It may be made totally out of carbide or another steel having a Rockwell C hardness preferably of 60 or greater, or it may just have a carbide tip. It has a threaded boss 52 terminating at a hexagonal flange 71 that transitions into a bell-shaped tip 54 from which a cylindrical tip 60 extends. (FIGS. 29-30)

Looking at FIG. 36 it can be seen that the imbed anchors 30, are "T" shaped pieces of metal having a planar, base flange 44 from which an internally threaded cylinder 46 extends. The base flange 44 completely resides within the outsole and does not extend to the top face of the outsole so are to reside in contact with the circular pads 29. The base flange 44 and the external walls of the cylinder are non-movably imbedded in outsole 6 such that the top of the cylinder 46 resides flush with the top of the cleat channels 34. The imbed anchors 30 are matingly engageable with the threaded fasteners that pass through the cleat orifices 48 of the hexagonal and chevron cleats 40 and 42, as well as the threaded boss 52 extending from the cleat stud 50. (FIG. 12)

When walking on less hard surfaces the sharp edges of the hexagonal or chevron cleats increase traction. Each of these cleats has at least one cleat orifice 48 formed there through with an inner circular seat circular seat 56 in the chevron or hexagonal cleats partway down the orifice 48. (FIGS. 19, 23 and 32) This seat contacts the bottom 61 of the head 63 of the mechanical fastener 58 that threadingly engages the imbed anchor 30 and draws the bottom faces of these cleats into tight contact with the hexagonal cleat detent 38 or the chevron cleat detent 36 formed in the cleat channels 34 of the outsole 6.

The chevron cleat 40 has at least two different lengths to accommodate the design and to accommodate different sizes of soles 2. The longest length chevron cleat (large chevron 40 of FIGS. 18 to 21) is used for the front two forward facing cleats and the shorter length chevron cleat (small chevron 41 of FIGS. 22-25) is used for the third (forward facing) and fourth and fifth (rearward facing) cleats. FIGS. 6-9 show the positioning and location of the large and small chevron cleats on the outsole 6 in the preferred embodiment. Here the edges of the chevron cleats extend out to the edge of the outsole 6. (FIG. 8)

The outsole is designed such that the two front large chevron cleats 40 face different directions that do the rear two small chevron cleats 41. This enhances the grip ability in both forward and backward direction movements. The three cleats are interchangeable and may be used in any configuration and any combination allowed by the spatial constraints of the outsole and the imbed anchor spacing. The outsole also has tapered sides 72 on all of the raised pads 32 narrowing toward the bottom of the sole 2. This allows the ejection of debris from the cleat channels 34 when the sole flexes. The raised pads 32 also have interior periphery tapered channels 70 on their exterior bottom surface that also open up when the sole 2 flexes so as to eject any debris such as mud that sticks to the bottom surface of the pads.

It is to be noted that the spacing between the sides of the cleats and the sides of the raised pads 32 are sized so as to allow the ejection of soft debris such as clay, dirt, sand and mud from off of the outsole in the cleat channels 34 when the sole 2 is flexed (as in walking) so as to prevent the buildup of any material on the bottom of the outsole 4 higher than the raised pads 32. This allows the cleats to always stand proud of the bottom face 26 of the outsole 6. It is also sized so as to eliminate the possibility of encountering and trapping any rock or debris large enough to get trapped between the raised pads 32 and the cleats so as to pry against the cleat sides and damage or dislodge them.

Looking at FIGS. 10-13, the sole 2 can be seen with the stud cleat 50 threaded into the imbeds 30. The configuration shown has only stud cleats 50 installed although a plethora of mixed style cleat combinations is possible depending on the terrain.

Looking at FIGS. 14-17 the embodiment with only hexagonal cleats 42 installed on the sole 2 can be seen.

The mechanical fasteners 58 are cap head bolts (FIGS. 26-28) having heads with a depth that is less than the depth of the seat 56 in the hexagonal and chevron cleats. The length of the threaded section of the mechanical fasteners is less than the combined depth of the imbed 30 plus the vertical thickness of the circular seat 56 to ensure that the mechanical fastener will not bottom out before it has securely affixed the cleats to the outsole 6.

In assembly, the chevron or hexagonal cleat is placed on the bottom face of the outsole 6 in the cleat detents such that the cleat orifice 48 aligns with the imbed anchor 30. Then the mechanical fastener 58 is threadingly engaged with the imbed anchor 30 passing through the cleat orifice 48 and rotated with the appropriate sized hex wrench until the bottom of its head contacts the circular seat 56 and draws the cleat tight to the appropriate cleat locating detent in the cleat channel 34. The head 70 of the mechanical fastener 58 resides below the top face of the cleat. Since the chevron cleats 40 or 41 have three cleat orifices each and use three mechanical fasteners to affix them to the outsole, they are dimensionally configured such that no part of them extends beyond the perimeter or footprint of the outsole 6. However, because of the close proximity of the hexagonal cleat 42 to the perimeter of the outsole 6, it would be possible to accidentally rotate and affix the hexagonal cleat 42 such that one of its corners 55 extended beyond the outsole 6. This is not desirable as force transmitted on this corner of the hexagonal cleat would not be transferred to the underlying outsole causing it to tip slightly and potentially damage the imbed 30. For this reason, the hexagonal locating detent 38 serves to locate the hexagonal cleat, and the step down in depth of the hexagonal locating detent from the cleat channel 31 prevents the hexagonal cleat frictionally from rotating when the last few turns of the mechanical fastener are 58 made. If the stud cleat 50 is desired anywhere on the outsole 6, the stud is threaded into any imbed 30 and a wrench or socket is connected onto the flats of the hexagonal flange 71 and rotated until the bottom of the stud cleat 50 contacts the outsole 6.

While certain features and aspects have been described with respect to exemplary embodiments, one skilled in the art will recognize that numerous modifications are possible. For example, in alternate embodiments the various cleats may be made of harder or softer materials, may be thicker or thinner, or may have alternate geometric configurations.

Components described according to a particular structural architecture may be organized in alternative structural architectures. Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

Having thus described the invention, what is claimed as new and desired to be secured by Letters Patent is as follows:

1. An all terrain outsole, comprising:

a polymer outsole having cleat channels formed between a series raised pads formed thereon a bottom face of said outsole;

at least one imbed anchor nut affixed within said polymer outsole, said anchor nut having a threaded opening approximately flush with said bottom face of said outsole;

at least one mechanical fastener threading engageable with said imbed anchor nuts;

at least one cleat having a cleat shape consisting of a hexagonal shape, a chevron shape, or a stud shape, said cleats each having at least one through bore sized to accommodate said mechanical fastener;

a cleat locating detent formed in each of said cleat channels, said cleat locating detent having at least one hexagonal first cleat detent formed within a chevron second cleat detent; wherein said first cleat detent is complimentary in configuration to said hexagonal cleat and said second cleat detent is complimentary in configuration to said chevron cleat; and wherein said at least one cleat is removeably affixed in said cleat channels by said mechanical fasteners which are threadingly engaged with said imbed anchor nuts.

2. The all terrain outsole of claim 1 further comprising:
a tapered channel formed about the interior periphery of an exterior bottom surface of said series of raised pads.

3. The all terrain outsole of claim 1 wherein said cleat channels extend completely across a width of said outsole.

4. The all terrain outsole of claim 1 where said imbed anchor nuts reside equidistant between said raised pads on opposing sides of said cleat channels.

5. The all terrain outsole of claim 1 wherein said raised pads have tapered sides.

6. The all terrain outsole of claim 1 wherein the number of cleat channels is five, and the number of hexagonal first cleat detents in each said chevron second cleat detent is three.

7. The all terrain outsole of claim 6 wherein each said cleat channel has an open end at an opposite side of said outsole, and where said hexagonal first cleat detent is positioned at each said open.

8. The all terrain sole of claim 1 wherein said at last one cleat has a dimension of cleat thickness that exceeds a dimension of raised pad thickness.

9. The all terrain sole of claim 1 further comprising;
an upper polymer outsole connection plate having an upper face and a lower face, said lower face affixed to a top face of said outsole, and said upper face having at least one locking lug extending upward there from;
wherein said at least one locking lug matingly engages a complimentary locking recess on a bottom face of an article of footwear.

10. The all terrain sole of claim 9 further comprising:
a heel strap affixed at a rear end of said outsole connection plate; and
a toe clip extending past a front end of said outsole connection plate;
wherein said heel strap has an orifice there through for engagement with a complimentary retention stud on said article of footwear; and
wherein said toe clip has a central retention slot for engagement with a tab on said article of footwear.

11. The all terrain sole of claim 10 further comprising:
a series of raised arced ridges formed along said upper face of said outsole connection plate; and
a set of stiffening ribs formed on said lower face of said outsole connection plate that make a series of rectangular voids thereon; and
at least one thickened pad formed thereon said lower face of said outsole connection plate, said stiffening pad located in a region directly above a location of said imbed anchor nut in said outsole; and
a mastic between said upper face of said outsole and said lower face of said outsole connection plate.

12. The all terrain outsole of claim 11 further comprising:
a cleat locating detent formed in each of said cleat channels, said cleat locating detent having at least one hexagonal first cleat detent formed within a chevron second cleat detent; wherein said first cleat detent is complimentary in configuration to said hexagonal cleat and said second detent is complimentary in configuration to said chevron cleat.

13. The all terrain outsole of claim 12 further comprising:
a tapered channel formed about the interior periphery of an exterior bottom surface of said series of raised pads.

14. The all terrain outsole of claim 13 wherein said cleat channels extend completely across a width of said outsole.

15. The all terrain outsole of claim 14 where said imbed anchor nuts reside equidistant between said raised pads on opposing sides of said cleat channels.

16. The all terrain outsole of claim 15 wherein said raised pads have tapered sides.

17. The all terrain outsole of claim 16 wherein the number of cleat channels is five, and the number of hexagonal first cleat detents in each said chevron second cleat detent is three.

18. The all terrain outsole of claim 17 wherein each said cleat channel has an open end at an opposite side of said outsole, and where said hexagonal first cleat detent is positioned at each said open.

19. The all terrain sole of claim 1 wherein said at least one cleat is at least two cleats having the cleat shapes that are identical in shape or different in shape selected among said cleat shape consisting of said hexagonal shape, said chevron shape, and said stud shape.

* * * * *